US012656065B2

(12) United States Patent
Wu et al.

(10) Patent No.: US 12,656,065 B2
(45) Date of Patent: Jun. 16, 2026

(54) HEAT EXCHANGER, HEAT EXCHANGE ASSEMBLY, AND HEAT MANAGEMENT SYSTEM

(71) Applicant: ZHEJIANG SANHUA AUTOMOTIVE COMPONENTS CO., LTD., Hangzhou (CN)

(72) Inventors: Linzhong Wu, Hangzhou (CN); Jintao Zhao, Hangzhou (CN); Qinghao Wu, Hangzhou (CN); Bin Song, Hangzhou (CN)

(73) Assignee: ZHEJIANG SANHUA AUTOMOTIVE COMPONENTS CO., LTD., Hangzhou (CN)

( * ) Notice: Subject to any disclaimer, the term of this patent is extended or adjusted under 35 U.S.C. 154(b) by 442 days.

(21) Appl. No.: 18/033,332

(22) PCT Filed: Oct. 21, 2021

(86) PCT No.: PCT/CN2021/125169
§ 371 (c)(1),
(2) Date: Apr. 22, 2023

(87) PCT Pub. No.: WO2022/083674
PCT Pub. Date: Apr. 28, 2022

(65) Prior Publication Data

US 2024/0011714 A1 Jan. 11, 2024

(30) Foreign Application Priority Data

Oct. 23, 2020 (CN) ..... 202011148716.8

(51) Int. Cl.
*F28D 9/00* (2006.01)
*F25B 39/02* (2006.01)
(Continued)

(52) U.S. Cl.
CPC ..... *F28D 9/005* (2013.01); *F25B 39/022* (2013.01); *F28D 9/0093* (2013.01); *F28F 9/0251* (2013.01); *F28D 2021/0071* (2013.01)

(58) Field of Classification Search
CPC ..... F28D 9/005; F28D 9/0093; F28D 9/0037; F28D 2021/0085; F28D 2021/0071;
(Continued)

(56) References Cited

U.S. PATENT DOCUMENTS 9,093,729 B2 7/2015 Wesner et al.
2010/0243200 A1 9/2010 Baker, Jr. et al.
(Continued)

FOREIGN PATENT DOCUMENTS

CN 106918165 A 7/2017
CN 107621182 A 1/2018
(Continued)

OTHER PUBLICATIONS

The European Search Report issued on Aug. 1, 2024 for EP21882089.2.
(Continued)

*Primary Examiner* — Jianying C Atkisson
*Assistant Examiner* — For K Ling
(74) *Attorney, Agent, or Firm* — Yue (Robert) Xu; Apex Attorneys at Law, LLP

(57) ABSTRACT

A heat exchanger, a heat exchange assembly, and a heat management system are provided. The heat exchanger includes a first heat exchange region and a second heat exchange region. The heat exchanger includes a first plate, a third plate, a fourth plate, and a second plate arranged in sequence. The third plate includes a mating hole, and the fourth plate includes a mating hole disposed opposite to and in mating communication with the mating hole of the third plate. The fourth plate includes a mating hole disposed
(Continued)

opposite to and in mating communication with the second plate, and the second plate includes a hole disposed opposite to and in mating communication with the fourth plate. A hole channel in the first heat exchange is communicated with a hole channel in the second heat exchange region via the third plate and the fourth plate.

10 Claims, 8 Drawing Sheets

(51) Int. Cl.
*F28F 9/02* (2006.01)
*F28D 21/00* (2006.01)

(58) Field of Classification Search
CPC ..... F25B 39/02; F25B 39/022; F25B 39/024; F25B 2339/024; F25B 2339/0241; F25B 2339/0242; F28F 9/0273
See application file for complete search history.

(56) References Cited

U.S. PATENT DOCUMENTS

| | | | | |
|---|---|---|---|---|
| 2012/0216562 | A1* | 8/2012 | Kadle | F28D 9/0093 62/434 |
| 2012/0234523 | A1 | 9/2012 | Jouanny et al. | |
| 2013/0061630 | A1* | 3/2013 | Schaefer | F28D 9/005 62/502 |
| 2014/0013787 | A1 | 1/2014 | Wesner et al. | |
| 2017/0176065 | A1* | 6/2017 | Kuroda | F28F 3/08 |
| 2017/0248373 | A1 | 8/2017 | Uchino | |
| 2018/0135916 | A1* | 5/2018 | Sueyoshi | B60H 1/00342 |
| 2020/0031198 | A1 | 1/2020 | Chen et al. | |
| 2020/0158380 | A1* | 5/2020 | Suzuki | F25B 25/005 |
| 2021/0178853 | A1* | 6/2021 | Heyl | F25B 39/04 |

FOREIGN PATENT DOCUMENTS

| | | | |
|---|---|---|---|
| CN | 210741194 | U | 6/2020 |
| CN | 215295918 | U | 12/2021 |
| DE | 102011008653 | A1 | 7/2012 |
| EP | 3663680 | A1 | 6/2020 |
| FR | 2802291 | A1 | 6/2001 |
| JP | 2001191786 | A | 7/2001 |
| JP | 2003214725 | A | 7/2003 |
| JP | 2010249499 | A | 11/2010 |
| KR | 20120095502 | A | 8/2012 |
| KR | 20190046989 | A | 5/2019 |
| WO | 2016117069 | A1 | 7/2016 |

OTHER PUBLICATIONS

The Japanese 1st Office Action issued on Jul. 3, 2024 for JP2023-524373.
International Search Report for PCT/CN2021/125169 mailed Jan. 18, 2022, ISA/CN.
The Korean 1st Office Action issued on Mar. 18, 2025 for KR10-2023-7016704.

* cited by examiner

HEAT EXCHANGER, HEAT EXCHANGE ASSEMBLY, AND HEAT MANAGEMENT SYSTEM

This application is the national phase of International Application No. PCT/CN2021/125169, titled "HEAT EXCHANGER, HEAT EXCHANGE ASSEMBLY, AND HEAT MANAGEMENT SYSTEM", filed on Oct. 21, 2021, which claims the priority to Chinese Patent Application No. 202011148716.8, titled "HEAT EXCHANGER, HEAT EXCHANGE ASSEMBLY, AND HEAT MANAGEMENT SYSTEM", filed on Oct. 23, 2020 with the China National Intellectual Property Administration, the entire disclosures thereof are incorporated herein by reference.

FIELD

The present application relates to the field of fluid control, and in particular to a heat exchanger, a heat exchange assembly, and a thermal management system.

BACKGROUND

Currently, some thermal management systems include two or more heat exchangers, such as plate evaporators. The heat exchangers and the parts are generally connected through pipelines and are fixed when applied in a system. The pipe connection of the system is relatively complex due to the large number of parts in the system.

SUMMARY

In order to solve the above problems, a heat exchanger, a heat exchange assembly and a thermal management system are provided according to the present application, to simplify the pipe connection of the thermal management system.

In a first aspect, a heat exchanger is provided according to the present application. The heat exchanger includes two heat exchange regions having different functions respectively and being small in size and easy to assemble. A thermal management system and a relatively simple heat exchange assembly applied to the thermal management system are further provided. The technical solutions are as follows.

A heat exchanger includes a first heat exchange region and a second heat exchange region. The first heat exchange region includes a first plate, and the second heat exchange region includes a second plate. The heat exchanger further includes a third plate and a fourth plate. A body portion of the third plate is located between the first plate and the fourth plate, and a body portion of the fourth plate is located between the third plate and the second plate. The second heat exchange region includes two fluid flow channels, where heat can be exchanged between the two fluid flow channels. The first heat exchange region includes a first hole passage and a second hole passage; the second heat exchange region includes four hole passages, namely a first hole passage, a second hole passage, a third hole passage and a fourth hole passage; two holes for communication, namely a first hole and a second hole are defined at a side, close to the first heat exchange region, of the second heat exchange region. The first hole and the second hole are defined in the second plate.

The fourth plate includes at least two matching holes, the third plate includes a matching hole facing one of the at least two matching holes of the fourth plate, and the one of the matching holes of the fourth plate positionally corresponds to and is in communication with the matching hole of the third plate, and another of the matching holes of the fourth plate positionally corresponds to and is in communication with one of the holes of the second plate.

The third plate may include at least one matching portion, and a matching hole is defined in the matching portion. The fourth plate includes at least two matching portions, and a matching hole is defined in each of the at least two matching portions. The matching portion of the third plate is arranged to face and secured by welding to one of the at least two matching portions of the fourth plate, and the matching hole in the matching portion of the third plate faces to and is in communication with one of the at least two matching holes of the fourth plate. The second plate includes at least one matching portion, one of the first hole and the second hole is defined in one of the matching portion. Another of the at least two matching portions of the fourth plate faces and is secured by welding to the matching portion of the second plate, another of the at least two matching holes of the fourth plate is in communication with the hole defined in the matching portion of the second plate. The second hole passage of the first heat exchange region is in communication with one of the hole passages of the second heat exchange region through the third plate and the fourth plate.

In a second aspect, a heat exchange assembly is provided according to the present application. The heat exchange assembly includes a throttling element, a connector and the heat exchanger provided in the above technical solutions. The throttling element is arranged relatively close to the first heat exchange region and is arranged with the heat exchanger in a secured or limited manner. The heat exchange assembly includes a first connection port, a second connection port, a third connection port and a fourth connection port. The connector is fixed to the heat exchanger, the second hole passage of the first heat exchange region is in communication with one of the fluid flow channels of the second heat exchange region. An inlet of the throttling element is in communication with the other of the fluid flow channels of the second heat exchange region, and an outlet of the throttling element is in communication with the first hole passage of the first heat exchange region.

The first heat exchange region may include two fluid flow channels, namely a refrigerant flow channel and a coolant flow channel, where the refrigerant flow channel includes the first hole passage and the second hole passage, and the coolant flow channel of the first heat exchange region includes a third hole passage and a fourth hole passage.

In a third aspect, a thermal management system is provided according to the present application. The thermal management system includes a refrigerant flow channel and further includes the above heat exchange assembly. The thermal management system further includes a compressor, a condenser and at least one evaporator. An outlet of the condenser is in communication with the first connection port through a pipeline or a liquid reservoir is arranged between an outlet of the condenser and the first connection port. An inlet of the compressor is in communication with the second connection port, an inlet of the evaporator is in communication with the third connection port or the vehicle thermal management system further includes a throttling element between an inlet of the evaporator and the third connection port, and an outlet of the evaporator is in communication with the fourth connection port.

By providing the four plates in the heat exchanger, two heat exchange regions with different functions can be formed into a one-piece structure by welding. A flow direction of the fluid in the heat exchange regions is controlled by providing the matching holes in the plates between the two heat exchange regions, the second hole passage of the first heat exchange region is in communication with one of the hole passages of the second heat exchange region, which facilitates assembling and makes the structure of the heat exchanger relatively small.

DETAILED DESCRIPTION OF THE EMBODIMENTS

Figure 1:
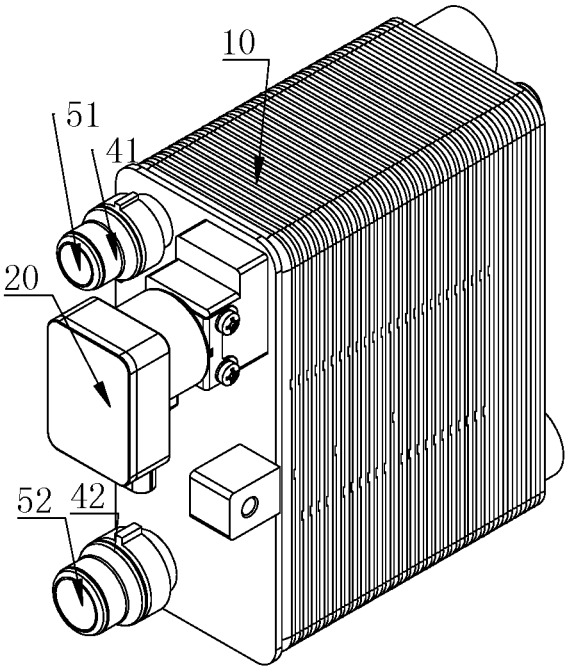
FIG. 1 is a first three-dimensional schematic view showing a heat exchange assembly according to the present application.
Figure 2:
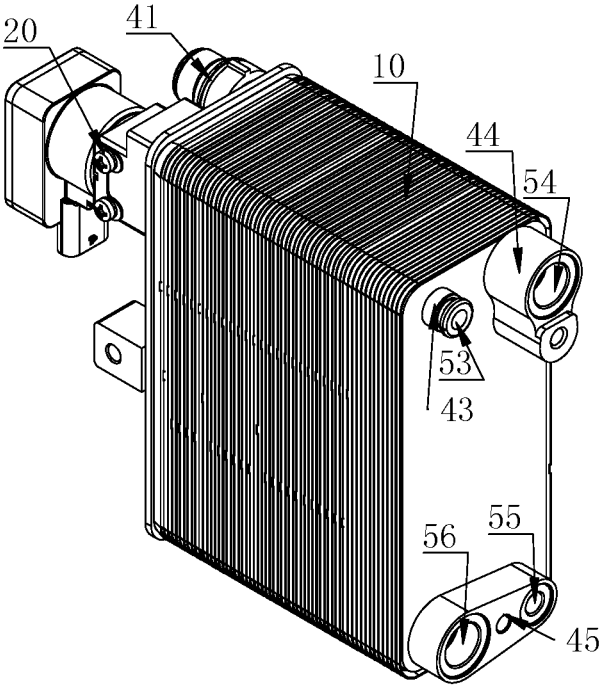
FIG. 2 is a second three-dimensional schematic view showing the heat exchange assembly according to the present application.
Figure 3:
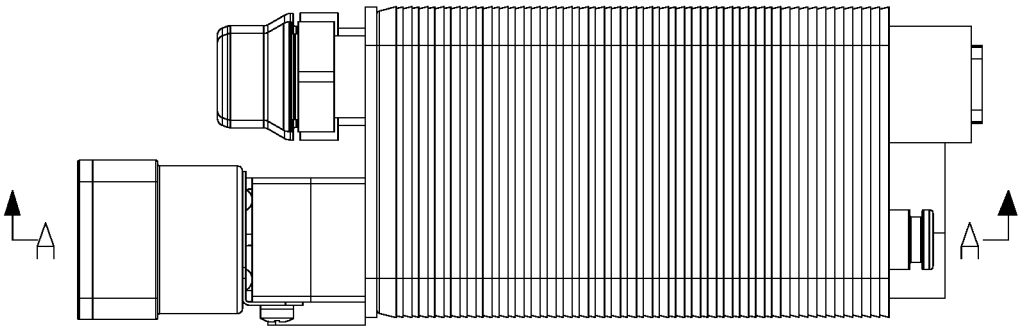
FIG. 3 is a schematic view of the heat exchange assembly.
Figure 4:
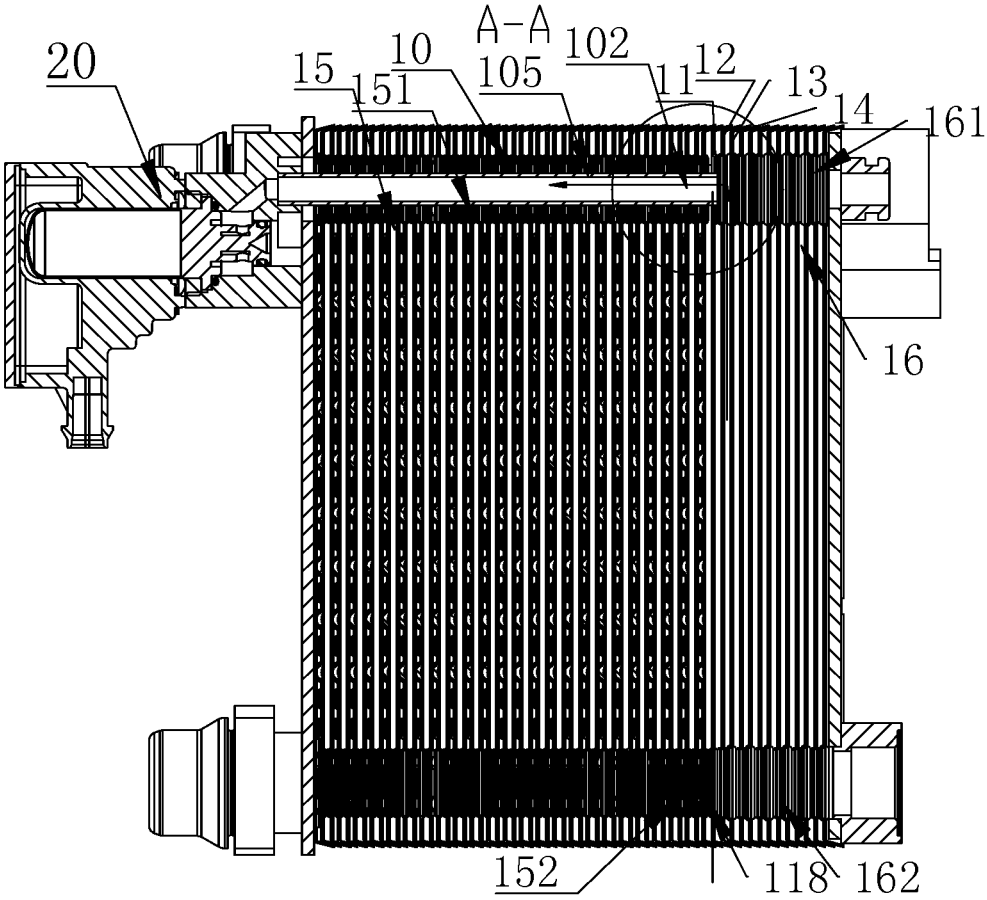
FIG. 4 is a schematic cross-sectional view of the heat exchange assembly in FIG. 3 taken in an A-A direction.
Figure 5:
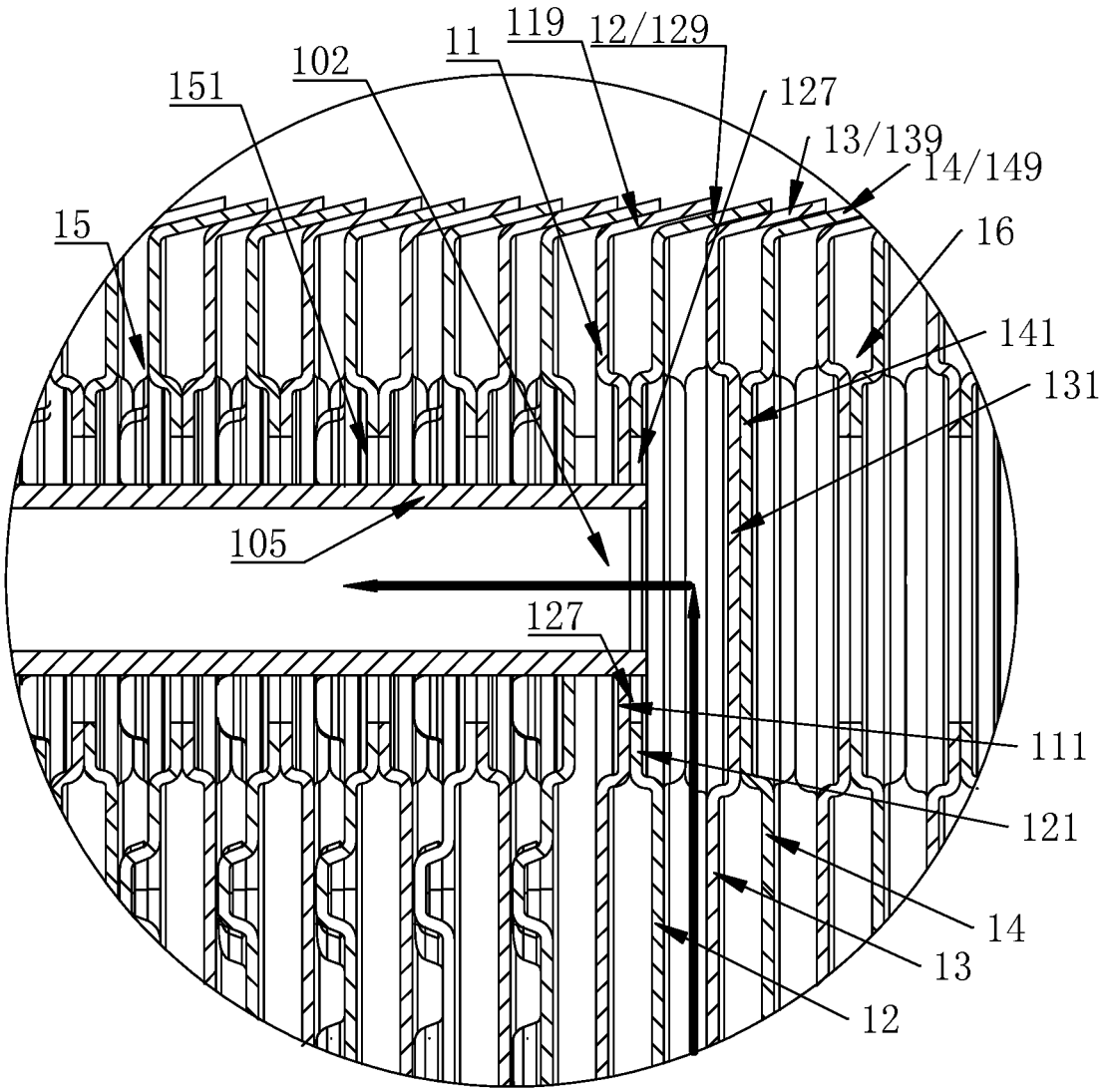
FIG. 5 is a partially enlarged schematic view of an embodiment of the heat exchange assembly in FIG. 4 according to the present application.
Figure 6:
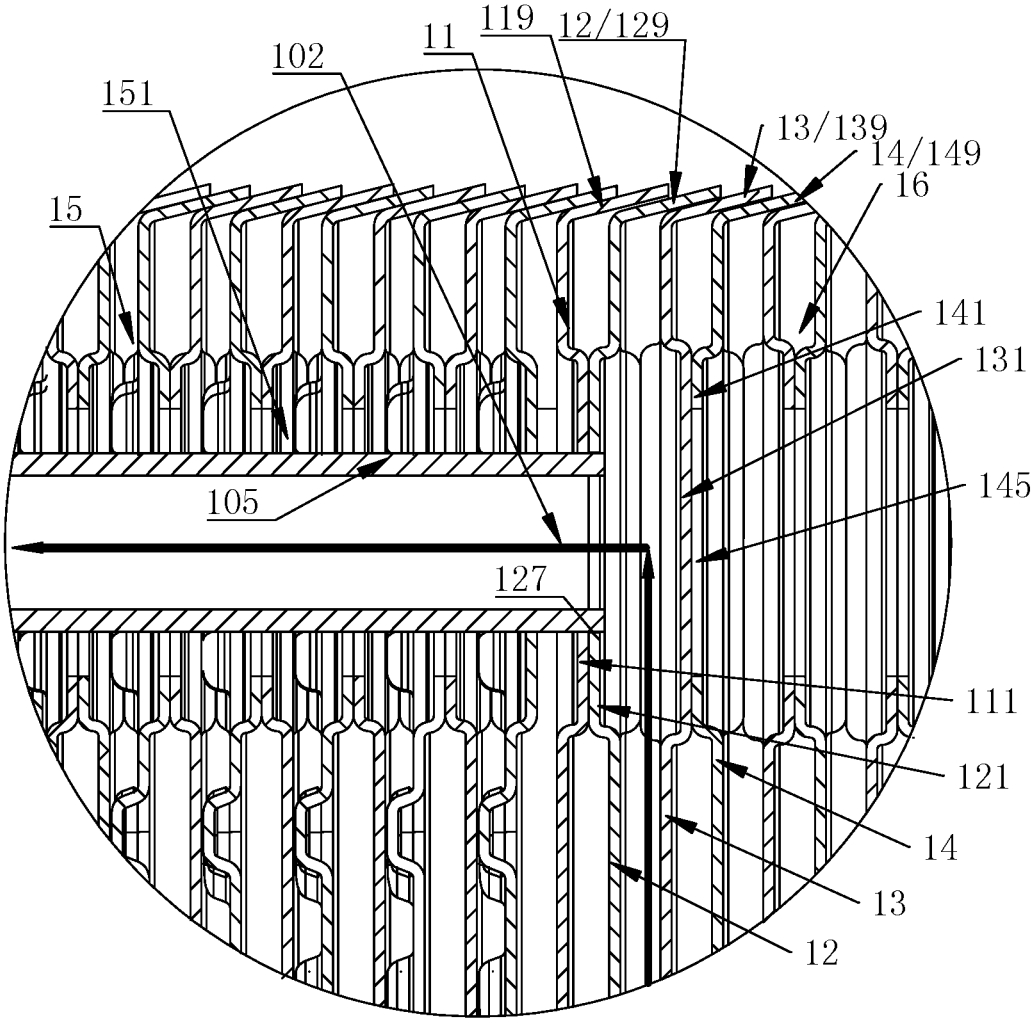
FIG. 6 is a partially enlarged schematic view of another embodiment of the heat exchange assembly according to the present application.
Figure 7:
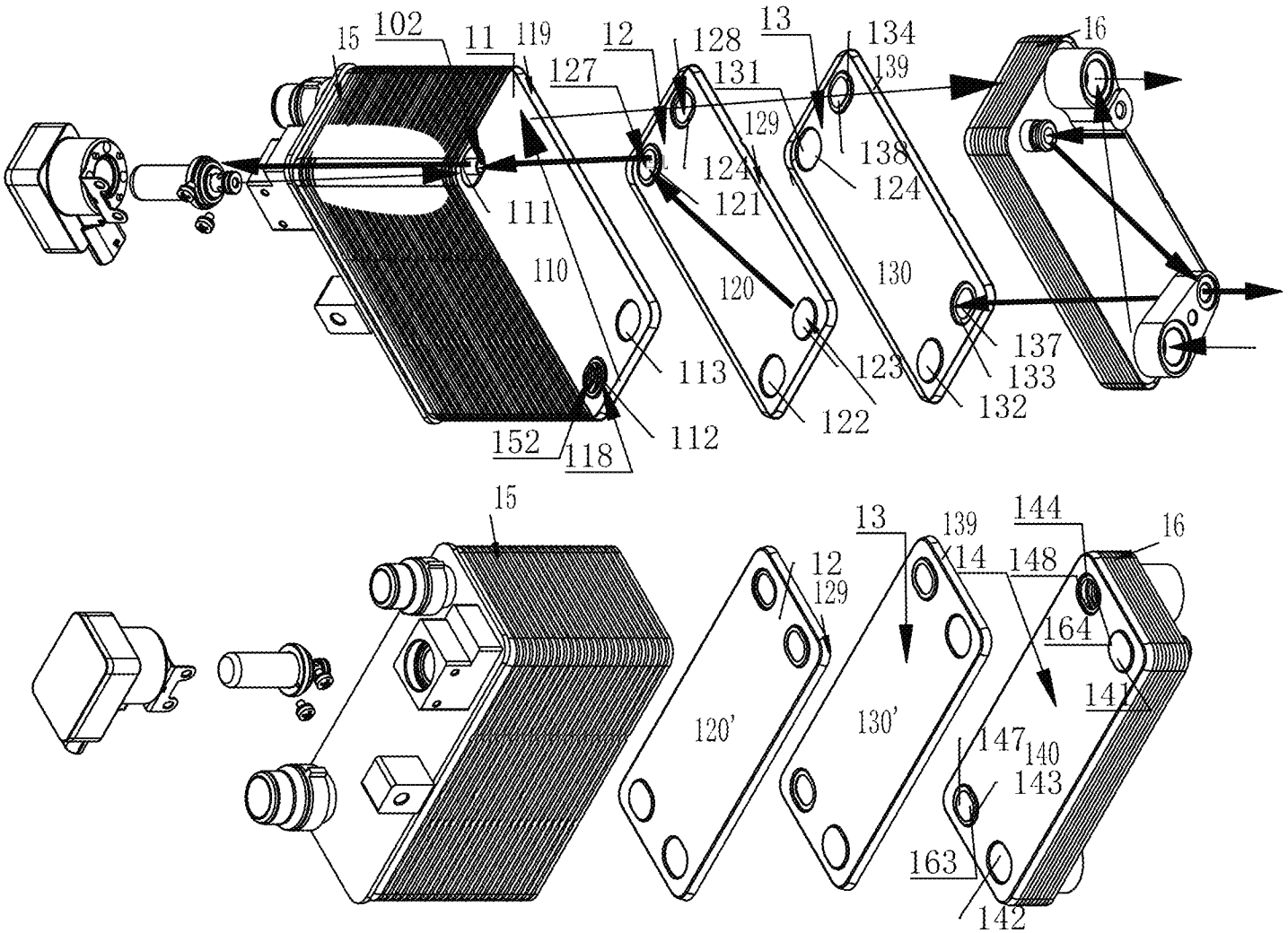
FIG. 7 is an exploded schematic view of the heat exchange assembly.

The technical solutions are described hereinafter in conjunction with specific embodiments. With reference to FIGS. 1 to 7, FIGS. 1 and 2 each shows a three-dimensional schematic view of a heat exchange assembly according to the present application. FIG. 3 is a schematic front view showing the heat exchange assembly. FIG. 4 is a schematic cross-sectional view showing the heat exchange assembly in FIG. 3 taken in an A-A direction. FIG. 5 is a partially enlarged schematic view of an embodiment of the heat exchange assembly in FIG. 4 according to the present application. FIG. 7 is an exploded schematic view of the heat exchange assembly. FIG. 6 is a partially enlarged schematic view of another embodiment of the heat exchange assembly according to the present application. The exploded schematic view illustrates the structure in two directions, and differs from the actual processing, which is mainly for illustrating the structure.

The heat exchange assembly includes a heat exchanger 10, a throttling element 20 and a connector.

The heat exchanger 10 includes a first heat exchange region 15, a second heat exchange region 16, a third plate 12 and a fourth plate 13.

A body portion of the third plate 12 is located between the first heat exchange region and the second heat exchange region 16, and a body portion of the fourth plate 13 is located between the first heat exchange region 15 and the second heat exchange region 16.

The first heat exchange region 15 includes a first plate 11, the second heat exchange region 16 includes a second plate 14, the body portion of the third plate 12 and the body portion of the fourth plate 13 are located between the first plate 11 and the second plate 14, and the third plate 12 is arranged between the first plate 11 and the fourth plate 13. In the embodiment, the first plate 11, the third plate 12, the fourth plate 13 and the second plate 14 are arranged in the listed sequence.

The first heat exchange region 15 has a heat exchange core, and the first heat exchange region 15 is provided with two fluid flow channels, fluids can flow through the two fluid flow channels and exchange heat with each other, and the two fluid flow channels are separated from each other.

The first heat exchange region 15 includes multiple plates, and the first heat exchange region 15 may further include fins to facilitate heat exchange. The first heat exchange region 15 is provided with interplate flow channels formed by the stacked plates, the first heat exchange region 15 enables at least two fluids to flow through, and the at least two fluids can exchange heat in the first heat exchange region 16; for example, one fluid is a refrigerant, and the other fluid may be a coolant such as coolant for cooling a heat generating element such as a battery. Alternatively, the first heat exchange region 15 enables three fluids to flow through, for example, one fluid is a refrigerant and the other two fluids may be coolants, and the two coolants may be selected by control for heat exchange with the refrigerant; the coolant, after being cooled down through heat exchange, can be used to cool components need to be cooled.

The first heat exchange region 15 may be provided with only one fluid flow channel and two hole passages namely a first hole passage 151, a second hole passage 152. For example, only a refrigerant flow channel is communicated and in contact with other elements or media requiring heat exchange to perform heat exchange.

The second heat exchange region 16 is provided with a heat exchange core. The second heat exchange region 16 includes plates, and the second heat exchange region 16 is provided with two fluid flow channels for fluid flow, and through which the heat exchange is performed. The two fluid flow channels are separated from each other by stacking of plates and are capable of heat exchange. The second heat exchange region 16 includes interplate flow channels formed by of the stacked plates, the second heat exchange region 16 enables at least two fluids to flow through, and the at least two fluids can perform heat exchange in the second heat exchange region 16. For example, the two fluids are refrigerants, where one fluid is a refrigerant with a relatively high temperature and the other is a refrigerant with a relatively low temperature; or, one fluid is a refrigerant and the other may be a coolant, such as a coolant for cooling a heat generating element such as a battery.

The second heat exchange region 16 is provided with four hole passages, namely a first hole passage 161, a second hole passage 162, a third hole passage 163, and a fourth hole passage 164.

A periphery of the first plate 11 is provided with a flange portion 119 flanged towards the third plate, a periphery of the third plate 12 is provided with a flange portion 129 flanged towards the fourth plate, a periphery of the fourth plate 13 is provided with a flange portion 139 flanged towards the second plate, and a periphery of the second plate 14 is provided with a flange portion 149 flanged towards the second heat exchange region. The plates are flanged in a same direction and are welded to form a relatively sealed structure, which avoids leaking from spaces between the plates through the peripheries. Alternatively, the plates may be flanged in an opposite direction, i.e., the plates may be flanged towards the first heat exchange region.

The first plate 11 is provided with a first matching portion 111 protruding towards the third plate, and a second matching portion 112 recessed towards the first heat exchange region. A hole is defined in the first matching portion 111 of the first plate 11. Part of a connection pipe 105 passes through the hole or one end of the connection pipe 105 may be substantially flush with the hole. The end of the connection pipe 105 matches and is welded to the first matching portion, so that the first hole passage 151 of the first heat exchange region is not in direct communication with a space between the first plate and the third plate and not in direct communication with a space between the third plate and the fourth plate. A hole 118 for fluid flow is defined in the second matching portion 112 of the first plate 11. The hole 118 is in communication with the second hole passage 152 of the first heat exchange region, or it can be said that the hole 118 is part of the second hole passage 152 of the first heat exchange region.

The third plate 12 is provided with a first matching portion 121 positionally corresponding to the first matching portion 111 of the first plate 11, the first matching portion 121 of the third plate 12 protrudes towards the first plate, and the first matching portion 121 of the third plate 12 and the first matching portion 111 of the first plate 11 may substantially abut against each other to match and be welded to each other. A first matching hole 127 is defined in the first matching portion of the third plate 12, a connection port 102 of the connection pipe 105 is in communication with the first matching hole 127 of the third plate 12, or the connection pipe 105 passes through the first matching hole 127 to match and be welded to the first matching portion of the third plate 12.

The third plate 12 is provided with a second matching portion 122 at a position facing the second matching portion 112 of the first plate 11, and the second matching portion 122 of the third plate 12 protrudes towards the fourth plate 13. The second matching portion 112 of the first plate 11 is of a structure recessed towards the first heat exchange region when viewed from the third plate. A distance between the second matching portion 122 of the third plate 12 and the second matching portion 112 of the first plate 11 is greater than a distance between a second main plate face 120' of the third plate 12 and a main plate face 110 of the first plate 11, such that a fluid can flow in a space formed between the second matching portion 122 of the third plate 12 and the second matching portion 112 of the first plate 11. The third plate 12 further includes a fourth matching portion 124, a second matching hole 128 is defined in the fourth matching portion 124 of the third plate 12, and the fourth matching portion 124 protrudes towards the fourth plate 13. Correspondingly, the fourth plate 13 is provided with a fourth matching portion 134 positionally corresponding to the fourth matching portion 124 of the third plate, the fourth matching portion 134 protrudes towards the third plate, the fourth matching portion 124 of the third plate 12 matches and is welded to the fourth matching portion 134 of the fourth plate 13, and the second matching hole 128 of the third plate 12 faces and is in communication with the fourth matching hole 138 of the fourth plate 13.

The third plate 12 may be further provided with a third matching portion 123, and the third matching portion 123 of the third plate 12 protrudes towards the first plate. In addition, the third plate 12 may be further provided with the second matching portion 122, and the second matching portion 122 of the third plate 12 protrudes towards the fourth plate. Alternatively, the third plate 12 may not be provided with the second matching portion and/or the third matching portion.

The fourth plate 13 is provided with a first matching portion 131, a third matching portion 133, and a fourth matching portion 134. The first matching portion 131 of the fourth plate 13 positionally corresponds to the first matching portion 121 of the third plate, and the fourth matching portion 134 of the fourth plate 13 positionally corresponds to the fourth matching portion 124 of the third plate. The first matching portion 131 of the fourth plate 13 protrudes towards the second plate, the third matching portion 133 of the fourth plate 13 protrudes towards the second plate, the fourth matching portion 134 of the fourth plate 13 protrudes towards the third plate, and the fourth matching portion 134 of the fourth plate 13 is sealed against the fourth matching portion 124 of the third plate 12 by matching and welding.

A third matching hole 137 is defined in the third matching portion 133 of the fourth plate 13, and a fourth matching hole 138 is defined in the fourth matching portion 134 of the fourth plate 13.

The second plate 14 is provided with a third matching portion 143 and a fourth matching portion 144. The third matching portion 143 of the second plate 14 positionally corresponds to the third matching portion 133 of the fourth plate. The second plate 14 may be further provided with the fourth matching portion 144, and the fourth matching portion 144 of the second plate 14 positionally corresponds to the fourth matching portion 134 of the fourth plate.

The third matching portion 143 of the second plate 14 protrudes towards the fourth plate, and the third matching portion 133 of the fourth plate 13 is sealed against the third matching portion 143 of the second plate 14 by matching and welding. A first hole 147 for fluid flow is defined in the third matching portion 143 of the second plate 14, and a second hole 148 for fluid flow is defined in the fourth matching portion 144 of the second plate 14. The first hole 147 is in communication with the third hole passage 163 of the second heat exchange region 16, or it can be said that the first hole 147 is part of the third hole passage 163 of the second heat exchange region. The second hole 148 is in communication with the fourth hole passage 164 of the second heat exchange region 16, or it can be said that the second hole 148 is part of the fourth hole passage 164 of the second heat exchange region.

The second plate 14 may be further provided with a first matching portion 141, the first matching portion 141 of the second plate 14 may protrude towards the fourth plate, and the first matching portion 141 of the second plate 14 may be sealed against the first matching portion 131 of the fourth plate 13 by matching and welding.

The space between the second main plate face 120' of the third plate 12 and the main plate face 110 of the first plate 11 is in communication with the hole 118 of the first plate. That is, the space between the second main plate face 120' of the third plate 12 and the main plate face 110 of the first plate 11 is in communication with the second hole passage 152 of the first heat exchange region. The space between the second main plate face 120' of the third plate 12 and the main plate face 110 of the first plate 11 is in communication with the second matching hole 128 of the third plate, in communication with the fourth matching hole 138 of the fourth plate, and in communication with the second hole 148 of the second plate, i.e., in communication with the fourth hole passage 164 of the second heat exchange region. The fourth hole passage 164 of the second heat exchange region is in communication with the second hole passage 152 of the first heat exchange region through the second matching hole 128 of the third plate and the fourth matching hole 138 of the fourth plate. The first matching hole 127 of the third plate is in communication with the connection port 102, and the other side of the connection port 102 is in communication with the throttling element 20.

A space between a main plate face 120 of the third plate 12 and a second main plate face 130' of the fourth plate 13 is in communication with the first matching hole 127 of the third plate or with the connecting port 102 of the connection pipe 105. The space between the main plate face 120 of the third plate 12 and the second main plate face 130' of the fourth plate 13 is in communication with the third matching hole 137 of the fourth plate 13. The third matching hole 137 of the fourth plate 13 is in communication with the first hole 147 of the second plate, that is, the third matching hole 137 of the fourth plate 13 is in communication with the third hole passage 163 of the second heat exchange region; that is, the third hole passage 163 of the second heat exchange region is in communication with the connection port 102 through the first matching hole 127 of the third plate and the third matching hole 137 of the fourth plate.

The connector includes a first connection port portion 43, a first connecting portion 44 and a second connecting portion 45. The first connection port portion 43 is provided with a first connection port 53, the first connecting portion 44 is provided with a second connection port 54, and the second connecting portion 45 is provided with a third connection port 55 and a fourth connection port 56.

In a specific vehicle air conditioning system, a high-temperature and high-pressure refrigerant may flow from the first connection port 53 into the first hole passage 161 of the second heat exchange region 16, to exchange heat with a refrigerant with a relatively low temperature in another fluid flow channel and then flows to the third hole passage 163. In the third hole passage 163 of the second heat exchange region 16, the refrigerant may be divided into two parts: one part flows to an evaporator of the system through the third connection port or through the throttling element, the refrigerant, after being evaporated in the evaporator, flows to the second hole passage 162 of the second heat exchange region 16 through the fourth connection port 56, and performs heat exchange with the refrigerant with a relatively high temperature in another fluid flow channel; the other part of the refrigerant flows through the third matching hole 137 of the fourth plate 13, the space between the third plate and the fourth plate, and the connection port 102 to get to the throttling element 20, and, after being throttled by the throttling element 20, flows to the first hole passage 151 of the first heat exchange region, in the first heat exchange region 15, the throttled refrigerant performs heat exchange with a medium in another fluid flow channel such as a coolant and flows to the second hole passage 152 of the first heat exchange region, after performing heat exchange in the first heat exchange region 15, the refrigerant flows through the space between the first plate and the third plate, the second matching hole 128 of the third plate, the fourth matching hole 138 of the fourth plate, the fourth hole passage 164 of the second heat exchange region, and flows out from the second connection port 54 and flows to a compressor, of course, the refrigerant may be returned back to the compressor after passing through components such as a vapor-liquid separator and the like.

In this solution, by providing the four plates in the heat exchanger, the two heat exchange regions with different functions can be formed into a one-piece structure by welding. The flow direction of the refrigerant can be controlled by the arrangement of the matching portions and the matching holes of the plates between the two heat exchange regions. In different situations of flow directions of refrigerant, the structures of the plates can be partially changed, for example, by changing the matching portions of the plates and the matching holes used for communication, various communication requirements for the system can be fulfilled, and the structure of the heat exchanger may be relatively small.

Alternatively, a hole may be defined in the matching portion, as shown in FIG. 6, the embodiment differs from the above embodiment in the following aspects: a hole 145 is defined in the first matching portion of the second plate and no hole is defined in the first matching portion of the fourth plate, and the first matching portion of the second plate is sealed against the first matching portion of the fourth plate by matching and welding. Alternatively, the above embodiment may be implemented in an opposite manner, that is, a hole is defined in the first matching portion of the fourth plate and no hole is defined in the first matching portion of the second plate. Besides, the connection pipe 105 with the connection port 102 may extend out of the first heat exchange region. The connection pipe 105 may be sealed against the first matching portion of the first plate by matching and welding. The connection pipe 105 may also extend into the first matching hole 127 of the third plate and is sealed against the first matching portion of the third plate by matching and welding. Here, the first matching hole 127 of the third plate is used for matching the connection pipe 105 instead of being used for communication.

Figure 8:
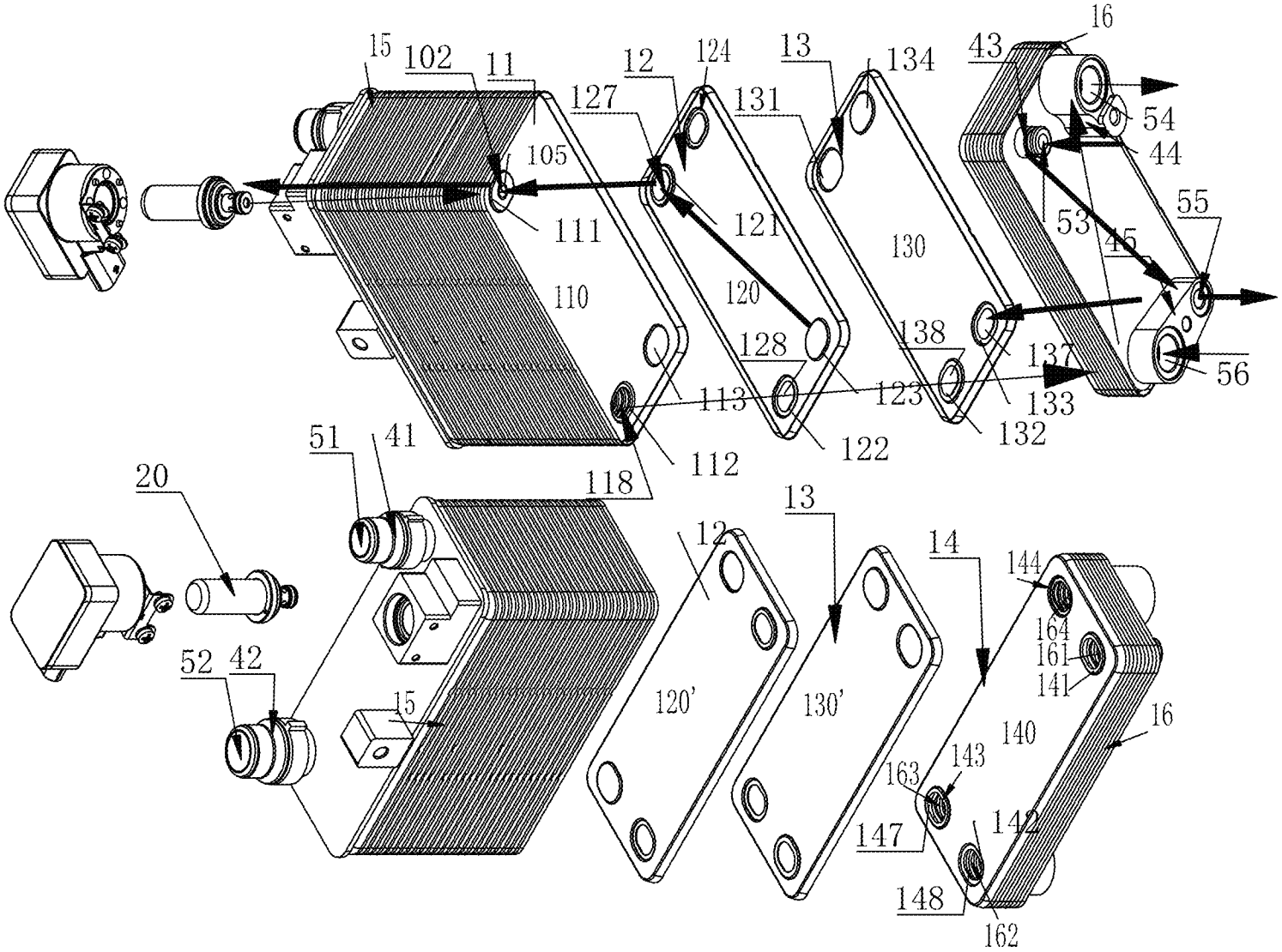
FIG. 8 is an exploded schematic view of a heat exchange assembly according to a second embodiment of the present application.

A specific embodiment may be as shown in FIG. 8, which shows an exploded schematic view of a heat exchange assembly according to a second embodiment of the present application from two directions. This embodiment may be referred to the above embodiments. The heat exchanger 10 includes a first heat exchange region 15, a second heat exchange region 16, a third plate 12 and a fourth plate 13. A body portion of the third plate 12 and a body portion of the fourth plate 13 are located between a first plate and a second plate. The first heat exchange region 15 includes the first plate 11, the second heat exchange region 16 includes the second plate 14, and the third plate 12 is arranged between the first plate 11 and the fourth plate 13. In the embodiment, the first plate 11, the third plate 12, the fourth plate 13 and the second plate 14 are arranged in the listed sequence.

The first plate 11 is provided with a first matching portion 111 protruding towards the third plate, and a second matching portion 112 recessed towards the first heat exchange region. The first plate 11 may be further provided with a third matching portion 113. A through-hole is defined in the first matching portion 111 of the first plate 11, and part of a connection pipe 105 passes through the through-hole; alternatively, one end of the connection pipe 105 may be substantially flush with the through-hole and is sealed against the first matching portion 111 by matching and welding. A hole 118 for fluid flow is defined in the second matching portion 112 of the first plate 11, the hole 118 is in communication with the second hole passage 152 of the first heat exchange region, or it can be said that the hole 118 is part of the second hole passage 152 of the first heat exchange region. The third plate 12 is provided with a first matching portion 121 positionally corresponding to the first matching portion 111 of the first plate 11, the first matching portion 121 of the third plate 12 protrudes towards the first plate, and the first matching portion 121 of the third plate 12 is sealed against the first matching portion 111 of the first plate 11 by matching and welding.

The third plate 12 is provided with a second matching portion 122 positionally corresponding to the second matching portion 112 of the first plate 11, and the second matching portion 122 of the third plate 12 protrudes towards the fourth plate 13. The second matching portion 112 of the first plate 11 is of a structure recessed towards the first heat exchange region when viewed from the third plate. A distance between the second matching portion 122 of the third plate 12 and the second matching portion 112 of the first plate 11 is greater than a distance between the second main plate face 120' of the third plate 12 and the main plate face 110 of the first plate 11. The third plate 12 may further include a third matching portion 123, and the third matching portion 123 of the third plate 12 protrudes towards the first plate 11. A first matching hole 127 is defined in the first matching portion of the third plate 12, a second matching hole 128 is defined in the second matching portion 122 of the third plate 12, the connection port 102 of the connection pipe 105 is in communication with the first matching hole 127 of the third plate 12, or the connection port 102 of the connection pipe 105 is in communication with a space between the third plate and the fourth plate. The second matching hole 128 of the third plate 12 is in communication with a part, relatively close to the third plate, of the second hole passage 152 of the first heat exchange region.

The second matching portion of the first plate and the second matching portion of the third plate may be not provided, as long as a hole is defined in the corresponding position to allow fluid communication. That is, the second hole passage 152 of the first heat exchange region may be in communication with the second heat exchange region through the hole for communication of the first plate, the space between the first plate and the third plate, the matching hole of the third plate and the matching hole of the fourth plate. The fourth plate 13 is provided with a second matching portion 132 positionally corresponding to the second matching portion 122 of the third plate, the second matching portion 132 of the fourth plate 13 protrudes towards the third plate, and the second matching portion 122 of the third plate 12 is sealed against the second matching portion 132 of the fourth plate 13 by matching and welding. The fourth plate 13 may be provided with a third matching portion 133 positionally corresponding to the third matching portion 123 of the third plate, the third matching portion 133 of the fourth plate 13 protrudes towards the second plate. A fourth matching hole 138 is defined in the second matching portion 132 of the fourth plate 13, and a third matching hole 137 is defined in the third matching portion 133 of the fourth plate 13.

The second plate 14 is provided with a second matching portion 142 and a third matching portion 143, the second matching portion 142 of the second plate 14 positionally corresponds to the second matching portion 132 of the fourth plate, and the third matching portion 143 of the second plate 14 positionally corresponds to the third matching portion 133 of the fourth plate. The third matching portion 143 of the second plate 14 protrudes towards the fourth plate. A first hole 147 for fluid flow is defined in the third matching portion 143 of the second plate 14, and a second hole 148 for fluid flow is defined in the second matching portion 142 of the second plate 14.

The first hole 147 of the second plate 14 is in communication with a third hole passage 163 of the second heat exchange region 16, or it can be said that the first hole 147 is part of the third hole passage 163 of the second heat exchange region. The second hole 148 is in communication with the second hole passage 162 of the second heat exchange region 16, or it can be said that the second hole 148 is part of the second hole passage 162 of the second heat exchange region. The third matching portion 133 of the fourth plate 13 is sealed against the third matching portion 143 of the second plate 14 by matching and welding.

The second plate 14 may be further provided with a first matching portion 141, and accordingly, the fourth plate is provided with a first matching portion 131, and the first matching portion 141 of the second plate 14 positionally corresponds to the first matching portion 131 of the fourth plate. The first matching portion 141 of the second plate 14 may protrude towards the fourth plate, the first matching portion 131 of the fourth plate 13 may protrude towards the second plate, and the first matching portion 131 of the fourth plate 13 is sealed against the first matching portion 141 of the second plate 14 by matching and welding. Or, the second plate 14 may be further provided with a fourth matching portion 144, and accordingly, the fourth plate is provided with a fourth matching portion 134, the fourth matching portion 144 of the second plate 14 positionally corresponds to the fourth matching portion 134 of the fourth plate, the fourth matching portion 144 of the second plate 14 protrudes towards the fourth plate, the fourth matching portion 134 of the fourth plate 13 protrudes towards the second plate, and the fourth matching portion 134 of the fourth plate 13 is sealed against the fourth matching portion 144 of the second plate 14 by matching and welding. The first matching portion or the fourth matching portion of the second plate may or may not be provided with a hole.

The second matching hole 128 of the third plate 12 is in communication with the fourth matching hole 138 of the fourth plate 13, and the space between the second main plate face 120' of the third plate 12 and the main plate face 110 of the first plate 11 is in communication with the second matching hole 128 of the third plate, with the fourth matching hole 138 of the fourth plate, and with the second hole 148 of the second plate. That is, the space is in communication with the second hole passage 162 of the second heat exchange region, the second hole passage 162 of the second heat exchange region is in communication with the second hole passage 152 of the first heat exchange region through the second matching hole 128 of the third plate and the fourth matching hole 138 of the fourth plate.

The first matching hole 127 of the third plate is in communication with the connection port 102, and the other side of the connection port 102 is in communication with the throttling element 20. The space between the main plate face 120 of the third plate 12 and the second main plate face 130' of the fourth plate 13 is in communication with the first matching hole 127 of the third plate and with the third matching hole 137 of the fourth plate 13. The third matching hole 137 of the fourth plate 13 is in communication with the first hole 147 of the second plate, i.e., the third matching hole 137 of the fourth plate 13 is in communication with the third hole passage 163 of the second heat exchange region. That is, the third hole passage 163 of the second heat exchange region is in communication with the connection port 102 through the first matching hole 127 of the third plate and the third matching hole 137 of the fourth plate. The flanges of the plates are directed towards a same side and are secured by welding and sealed against each other.

Likewise, the connector includes a first connection port portion 43, a first connecting portion 44 and a second connecting portion 45. The first connection port portion 43 is provided with a first connection port 53, the first connecting portion 44 is provided with a second connection port 54, and the second connecting portion 45 is provided with a third connection port 55 and a fourth connection port 56.

In a vehicle air conditioning system, the first connection port portion 43 may be in communication with an outlet portion of a compressor, the first connecting portion 44 may be in communication with an inlet portion of the compressor, the second connection port 54 may be in communication with an air return port of the compressor, the second connecting portion may be in communication with inlet and outlet portions of an evaporator, the third connection port 55 may be in communication with the evaporator or the throttling element or the like of the system, and the fourth connection port 56 may be in communication with an outlet of the evaporator or an outlet of a vapor-liquid separator or the like.

When the system is in operation, the high-temperature and high-pressure refrigerant coming from the compressor may flow from the first connection port 53 into the communicated the first hole passage 161 of the second heat exchange region 16 and flow to the third hole passage 163, and exchanges heat with a refrigerant with a relatively low temperature in another fluid flow channel in the second heat exchange region 16. In the third hole passage 163 of the second heat exchange region 16, the refrigerant may be divided into two parts. One part flows to the evaporator of the system through the third connection port 55 or through the throttling element or the like, or flows to two evaporators after being throttled; the refrigerant, after being evaporated in the evaporator, flows to the second hole passage 162 of the second heat exchange region 16 through the fourth connection port 56 and flows to the fourth hole passage 164, and performs heat exchange with the refrigerant with a relatively high temperature in the another fluid flow channel. The other part of the refrigerant flows to the throttling element 20 through the first hole 147 of the second plate, the third matching hole 137 of the fourth plate 13, the space between the first main plate face 120 of the third plate and the second main plate face 130' of the fourth plate, and the connecting port 102; and, after being throttled by the throttling element 20, flows to a part, relatively close to the side where the throttling element is located, of the first hole passage 151 of the first heat exchange region; the refrigerant exchanges heat with a medium of another fluid flow channel, such as a coolant, in the first heat exchange region 15, flows to the second hole passage 152 of the first heat exchange region to complete heat exchange, and passes through the second matching hole 128 of the third plate, the fourth matching hole 138 of the fourth plate and the second hole 148 of the second plate to get to the second hole passage 162 of the second heat exchange region, and flows, together with the refrigerant coming back from the fourth connection port 56, to the fourth hole passage 164, to perform heat exchange with the refrigerant in the another fluid flow channel, and flows out through the second connection port 54 in communication with the fourth hole passage 164 and flows to the compressor, of course, it may also flow back to the compressor through a vapor-liquid separator or the like.

In this embodiment, the two refrigerants with a low temperature are converged to perform heat exchange with the refrigerant with a relatively high temperature. Other structures and operating modes may be referred to the first embodiment above.

Figure 9:
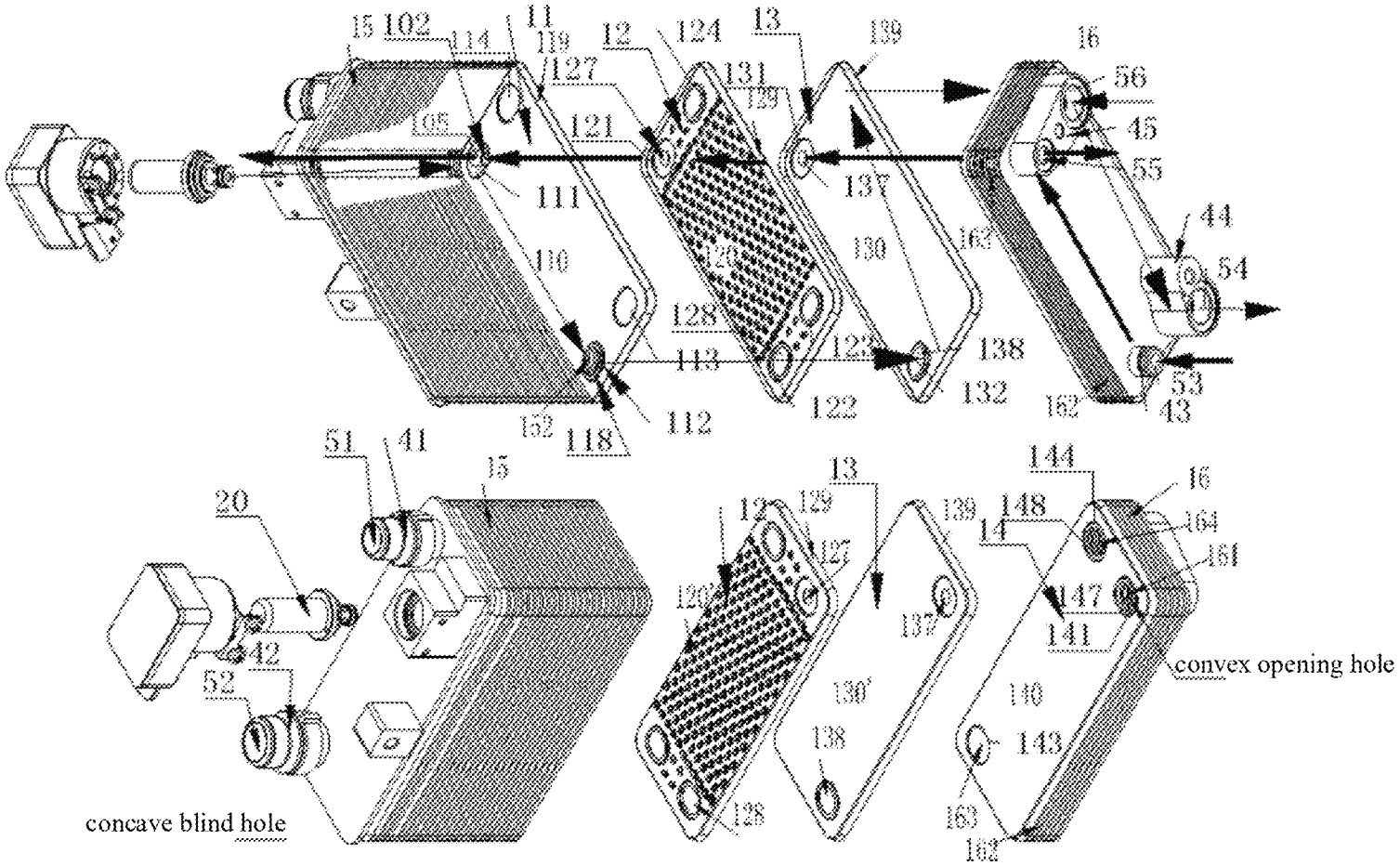
FIG. 9 is an exploded schematic view of a heat exchange assembly according to a third embodiment of the present application.

A third embodiment is described below, as shown in FIG. 9, which shows an exploded schematic view of a heat exchange assembly according to the third embodiment of the present application.

Likewise, the heat exchanger 10 includes a first heat exchange region 15, a second heat exchange region 16, a third plate 12, and a fourth plate 13. A body portion of the third plate 12 and a body portion of the fourth plate 13 are located between the first heat exchange region 15 and the second heat exchange region 16. The first heat exchange region 15 includes a first plate 11, the second heat exchange region 16 includes a second plate 14, the third plate 12 and the fourth plate 13 are arranged between the third plate 12 and the second plate 14, the third plate 12 is arranged between the first plate 11 and the fourth plate 13, and the first plate 11, the third plate 12, the fourth plate 13, the second plate 14 are arranged in the listed sequence.

The first plate 11 is provided with a first matching portion 111 protruding towards the third plate and may be provided with a second matching portion 112 recessed towards the first heat exchange region. In addition, the first plate 11 may be provided with a third matching portion 113 or a fourth matching portion 114.

A through-hole is defined in the first matching portion 111 of the first plate 11. Part of a connection pipe 105 passes through the through-hole, or one end of the connection pipe 105 may be substantially flush with the through-hole, to be sealed against the first matching portion 111 by matching and welding. Alternatively, one end of the connection pipe 105 may be sealed against the third plate by matching and welding, while the connection pipe is sealed against the first plate by matching and welding.

A hole 118 for fluid flow is defined in the second matching portion 112 of the first plate 11. The hole 118 is in communication with the second hole passage 152 of the first heat exchange region, or it can be said that the hole 118 is part of the second hole passage 152 of the first heat exchange region.

The third plate 12 is provided with multiple concave-convex portions in a main plate area. The concave-convex portions may also be arranged in the fourth plate or the like. The third plate 12 is provided with a first matching portion 121 positionally corresponding to the first matching portion 111 of the first plate 11, the first matching portion 121 of the third plate 12 may protrude towards the first plate, and the first matching portion 121 of the third plate 12 and the first matching portion 111 of the first plate 11 may be sealed against each other by matching and welding or may be sealed against the connection pipe by matching and welding.

The third plate 12 is provided with a second matching portion 122 positionally corresponding to the second matching portion 112 of the first plate 11, the second matching portion 122 of the third plate 12 protrudes towards the fourth plate 13, and the second matching portion 112 of the first plate 11 may be of a structure recessed towards the first heat exchange region when viewed from the third plate.

The third plate 12 may further include a third matching portion 123 or a fourth matching portion 124. A first matching hole 127 is defined in the first matching portion of the third plate 12 for communication or for matching with the connection pipe. A second matching hole 128 is defined in the second matching portion 122 of the third plate 12, the connection port 102 of the connection pipe 105 is in communication with the first matching hole 127 of the third plate 12, or the connection pipe matches and is welded to the hole of the second matching portion of the third plate, or the connection port 102 of the connection pipe 105 is in communication with the space between the third plate and the fourth plate. The second matching hole 128 of the third plate 12 is in communication with the hole 118 of the first plate, and the second matching hole 128 of the third plate 12 is in communication with a part, relatively close to the third plate, of the second hole passage 152 of the first heat exchange region.

The fourth plate 13 is provided with a first matching portion 131. The first matching portion 131 may be arranged positionally corresponding to the first matching portion 121 of the third plate, or at other available positions.

The fourth plate 13 is provided with a second matching portion 132 positionally corresponding to the second matching portion 122 of the third plate, the second matching portion 132 of the fourth plate 13 protrudes towards the third plate, and the second matching portion 122 of the third plate 12 is sealed against the second matching portion 132 of the fourth plate 13 by matching and welding.

A fourth matching hole 138 is defined in the second matching portion 132 of the fourth plate 13, and a third matching hole 137 is defined in the first matching portion 131 of the fourth plate 13.

The second plate 14 is provided with a first matching portion 141 and a fourth matching portion 144, the first matching portion 141 of the second plate 14 is positionally corresponding to the first matching portion 131 of the fourth plate, and the first matching portion 141 of the second plate 14 protrudes towards the fourth plate.

A first hole 147 for fluid flow is defined in the first matching portion 141 of the second plate 14, and a second hole 148 for fluid flow is defined in the fourth matching portion 144 of the second plate 14. The first hole and the second hole each is a hole of a corresponding fluid flow channel of the second heat exchange region for communication.

The first hole 147 of the second plate 14 is in communication with the first hole passage 161 of the second heat exchange region 16, or it can be said that the first hole 147 is part of the first hole passage 161 of the second heat exchange region. The second hole 148 is in communication with the fourth hole passage 164 of the second heat exchange region 16, or it can be said that the second hole 148 is part of the fourth hole passage 164 of the second heat exchange region.

The second plate 14 may further be provided with a third matching portion 143. The first matching portion 141 of the second plate 14 is positionally corresponding to the first matching portion 131 of the fourth plate in position, and the first matching portion 141 of the second plate 14 protrudes towards the fourth plate. The first matching portion 131 of the fourth plate 13 protrudes towards the second plate, and the first matching portion 131 of the fourth plate 13 is sealed against the first matching portion 141 of the second plate 14 by matching and welding. The fourth matching portion 144 of the second plate 14 is recessed towards the second heat exchange region.

The second matching hole 128 of the third plate 12 is in communication with the fourth matching hole 138 of the fourth plate 13, the space between the second main plate face 120' of the third plate 12 and the main plate face 110 of the first plate 11 is in communication with the first matching hole 127 of the third plate or with the connection port, and is in communication with the third matching hole 137 of the fourth plate, and with the first hole 147 of the second plate, that is, being in communication with the first hole passage 161 of the second heat exchange region, the first hole passage 161 of the second heat exchange region is in communication with the connection port 102 through the first matching hole 127 of the third plate and the third matching hole 137 of the fourth plate, and the other side of the connection port 102 is in communication with the throttling element 20.

The second matching hole 128 of the third plate is in communication with the second hole passage 152 of the first heat exchange region. The space between the main plate face 120 of the third plate 12 and the second main plate face 130' of the fourth plate 13 is in communication with the first matching hole 127 of the third plate or with the connection port 102. The space between the main plate face 120 of the third plate 12 and the second main plate face 130' of the fourth plate 13 is in communication with the third matching hole 137 of the fourth plate. The third matching hole 137 of the fourth plate 13 is in communication with the first hole 147 of the second plate, i.e., the third matching hole 137 of the fourth plate 13 is in communication with the first hole passage 161 of the second heat exchange region. The first hole passage 161 of the second heat exchange region is in communication with the connection port 102 through the first matching hole 127 of the third plate and the third matching hole 137 of the fourth plate; alternatively, the first hole passage 161 of the second heat exchange region is in communication with the connection port 102 through the third matching hole 137 of the fourth plate.

The connector according to this embodiment includes a first connection port portion 43, a first connecting portion 44 and a second connecting portion 45. The first connection port portion 43 is provided with a first connection port 53, the first connecting portion 44 is provided with a second connection port 54, and the second connecting portion 45 is provided with a third connection port 55 and a fourth connection port 56.

In a specific vehicle air conditioning system, the first connection port portion 43 may be in communication with an outlet portion of a compressor, the second connection port 54 of the first connecting portion 44 may be in communication with an air return port of the compressor, a third connection port 55 of the second connecting portion 45 may be in communication with the evaporator or throttling element or the like of the system, and the fourth connection port 56 may be in communication with an outlet of the evaporator or an outlet of a vapor-liquid separator or the like.

When the system is in operation, a high-temperature and high-pressure refrigerant may flow from the first connection port 53 into the second hole passage 162 of the second heat exchange region 16 (not illustrated in the figures), and exchanges heat in the second heat exchange region 16 with a refrigerant with a relatively low temperature in another fluid flow channel, and then flows to the first hole passage 161. In the first hole passage 161 of the second heat exchange region 16, the refrigerant is divided into two parts. One part of the refrigerant flows to the evaporator of the system through the third connection port 55 or through the throttling element, or flows to two evaporators after being throttled; the refrigerant, after being evaporated in the evaporator, flows to the fourth hole passage 164 of the second heat exchange region 16 through the fourth connection port 56, and performs heat exchange with the refrigerant with a relatively high temperature in the another fluid flow channel. The other part of the refrigerant flows to the throttling element 20 through the first hole 147 of the second plate, the third matching hole 137 of the fourth plate 13, the space between the first main plate face 120 of the third plate and the second main plate face 130' of the fourth plate or the first matching hole 127 of the third plate, and the connection port 102; and, after being throttled by the throttling element 20, the other part of the refrigerant flows to a part, relatively close to a side where the throttling element is located, of the first hole passage 151 of the first heat exchange region, exchanges heat with the medium in the another fluid flow channel, such as a coolant, in the first heat exchange region 15, flows to the second hole passage 152 of the first heat exchange region, and flows to the fourth hole passage 164 of the second heat exchange region through the second matching hole 128 of the third plate, the fourth matching hole 138 of the fourth plate, the space between the first main plate face 130 of the fourth plate and the main plate face 140 of the second plate, and the second hole 148 of the second plate, and is converged with the refrigerant coming back from the fourth connection port 56 and flows to the third hole passage 163, to perform heat exchange with the refrigerant in another fluid flow channel, and flows out through the second connection port 54 in communication with the third hole passage 163 to get to the compressor, of course, it may be returned back to the compressor through a vapor-liquid separator or the like.

Other structures and modes of this embodiment may be referred to the above first embodiment.

Figure 10:
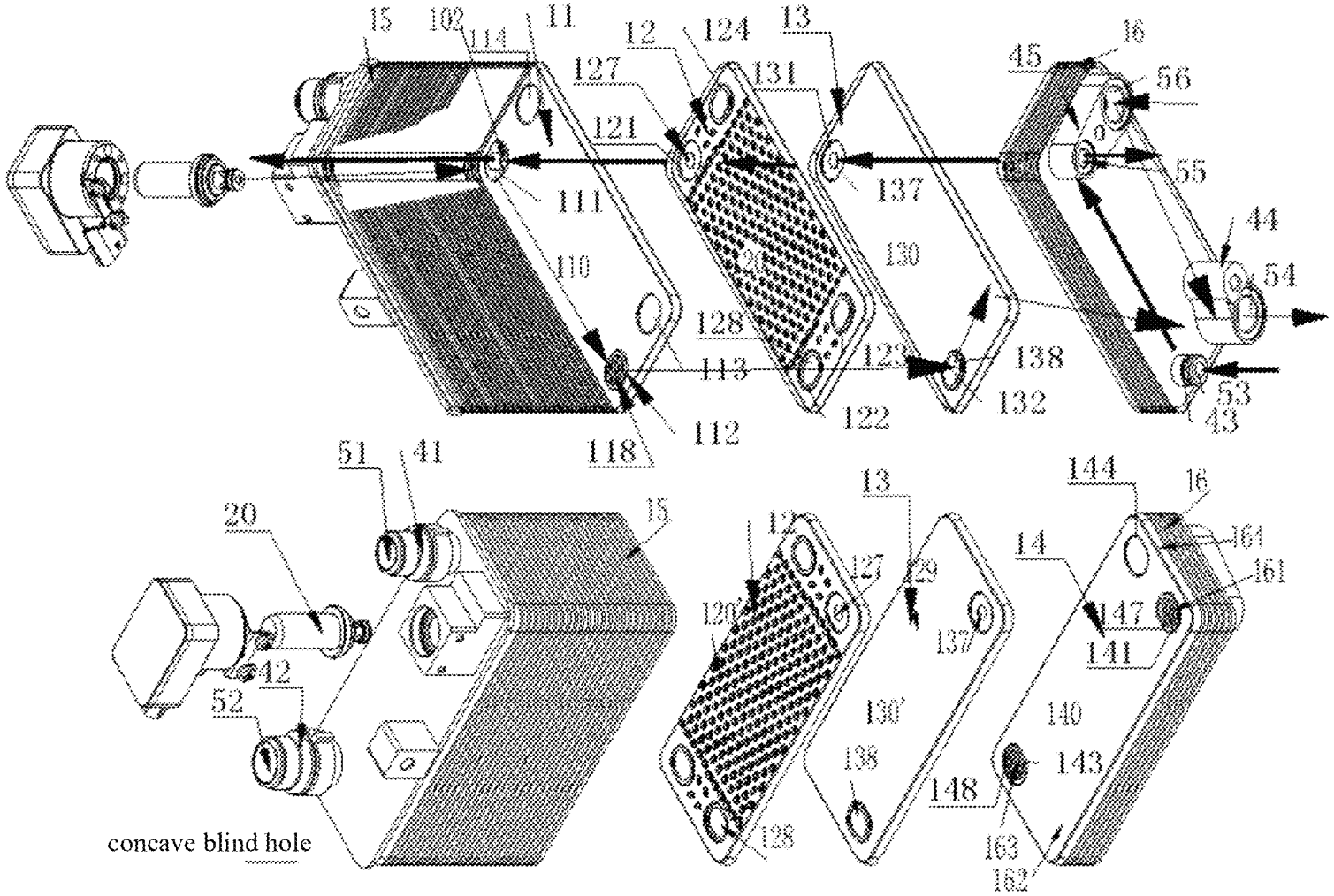
FIG. 10 is an exploded schematic view of a heat exchange assembly according to a fourth embodiment of the present application.

In the above second and third embodiments, the refrigerant with a relatively low temperature performs heat exchange with the refrigerant with a relatively high temperature in the second heat exchange region. Besides, the case may be that part of the refrigerant with a low temperature is involved in the heat exchange in the second heat exchange region, as shown in FIG. 10, which is an exploded schematic view of a heat exchange assembly according to a fourth embodiment of the present application.

Likewise, the heat exchanger 10 includes a first heat exchange region 15, a second heat exchange region 16, a third plate 12 and a fourth plate 13, and the first plate 11, the third plate 12, the fourth plate 13 and the second plate 14 are arranged in the listed sequence.

The first plate 11 is provided with a first matching portion 111 protruding towards the third plate, and a second matching portion 112 recessed towards the first heat exchange region. In addition, the first plate 11 may be provided with a third matching portion 113 and a fourth matching portion 114.

A through-hole matching the connection pipe 105 is defined in the first matching portion 111 of the first plate 11, one end of the connection pipe 105 may be substantially flush with the through-hole and is sealed against the first matching portion 111 by matching and welding; or, one end of the connection pipe 105 may be sealed against the third plate by matching and welding, while the connection pipe is sealed against the first plate by matching and welding. A hole 118 for fluid flow is defined in the second matching portion 112 of the first plate 11, the hole 118 is part of the second hole passage 152 of the first heat exchange region. The third plate 12 or the fourth plate is provided with multiple concave-convex portions in a main plate area thereof.

The third plate 12 is provided with a first matching portion 121 positionally corresponding to the first matching portion 111 of the first plate 11, the first matching portion 121 of the third plate 12 may protrude towards the first plate, and the first matching portion 121 of the third plate 12 and the first matching portion 111 of the first plate 11 may be sealed against each other by matching and welding, or the connection pipe is sealed against the first matching portion of the third plate by matching and welding.

The third plate 12 is provided with a second matching portion 122, and the second matching portion 122 of the third plate 12 protrudes towards the fourth plate 13. The third plate 12 may further include a third matching portion 123 or a fourth matching portion 124. A first matching hole 127 is defined in the first matching portion of the third plate 12, and a second matching hole 128 is defined in the second matching portion 122 of the third plate 12, the connection port 102 of the connection pipe 105 is in communication with the first matching hole 127 of the third plate 12, or the connection pipe matches and is welded to the hole of the second matching portion of the third plate, or the connection port 102 of the connection pipe 105 is in communication with the space between the third plate and the fourth plate. The second matching hole 128 of the third plate 12 is in communication with the hole 118 of the first plate, and the second matching hole 128 of the third plate 12 is in communication with a part, relatively close to the third plate, of the second hole passage 152 of the first heat exchange region.

The fourth plate 13 is provided with a first matching portion 131, which may be arranged positionally corresponding to the first matching portion 121 of the third plate. Since the flow path is communicated through the space between the third plate and the fourth plate, positions of the matching portions and the matching holes may be adjusted according to the structure of the first heat exchange region and the second heat exchange region, or may be adjusted according to the structure of the first plate and the second plate, i.e., may be arranged in other available positions, which facilitates the adjustment.

The fourth plate 13 is provided with a second matching portion 132 positionally corresponding to the second matching portion 122 of the third plate, the second matching portion 132 of the fourth plate 13 protrudes towards the third plate, and the second matching portion 122 of the third plate 12 and the second matching portion 132 of the fourth plate 13 are sealed against each other by matching and welding.

A fourth matching hole 138 is defined in the second matching portion 132 of the fourth plate 13, and a third matching hole 137 is defined in the first matching portion 131 of the fourth plate 13. The first matching portion 131 of the fourth plate 13 may be provided with a hole for matching the connection pipe.

The second plate 14 is provided with a first matching portion 141 and a third matching portion 143. The first matching portion 141 of the second plate 14 is positionally corresponding to the first matching portion 131 of the fourth plate in position, and the first matching portion 141 of the second plate 14 protrudes towards the fourth plate.

A first hole 147 for fluid flow is defined in the first matching portion 141 of the second plate 14, and a second hole 148 for fluid flow is defined in the third matching portion 143 of the second plate 14. The first hole 147 of the second plate 14 is in communication with the first hole passage 161 of the second heat exchange region 16, or it can be said that the first hole 147 is part of the first hole passage 161 of the second heat exchange region. The second hole 148 is in communication with the third hole passage 163 of the second heat exchange region 16, or it can be said that the second hole 148 is part of the third hole passage 163 of the second heat exchange region.

The second plate 14 may further be provided with a third matching portion or a fourth matching portion 144.

The first matching portion 141 of the second plate 14 positionally corresponds to the first matching portion 131 of the fourth plate, the first matching portion 141 of the second plate 14 protrudes towards the fourth plate, the first matching portion 131 of the fourth plate 13 protrudes towards the second plate, and the first matching portion 131 of the fourth plate 13 and the first matching portion 141 of the second plate 14 are sealed against each other by matching and welding. The third matching portion 143 of the second plate 14 is recessed towards the second heat exchange region.

The second matching hole 128 of the third plate 12 is in communication with the fourth matching hole 138 of the fourth plate 13, and the third matching hole 137 of the fourth plate is in communication with the first hole 147 of the second plate, i.e., being in communication with the first hole passage 161 of the second heat exchange region. The first hole passage 161 of the second heat exchange region is in communication with the connection port 102 through the first matching hole 127 of the third plate and the third matching hole 137 of the fourth plate. The other side of the connection port 102 is in communication with the throttling element 20. The second matching hole 128 of the third plate is in communication with the second hole passage 152 of the first heat exchange region.

The space between the main plate face 120 of the third plate 12 and the second main plate face 130' of the fourth plate 13 is in communication with the first matching hole 127 of the third plate or the connection port 102, and the space between the main plate face 120 of the third plate 12 and the second main plate face 130' of the fourth plate 13 is in communication with the third matching hole 137 of the fourth plate.

The third matching hole 137 of the fourth plate 13 is in communication with the first hole 147 of the second plate. That is, the third matching hole 137 of the fourth plate 13 is in communication with the first hole passage 161 of the second heat exchange region.

The first hole passage 161 of the second heat exchange region is in communication with the connection port 102 through the first matching hole 127 of the third plate and the third matching hole 137 of the fourth plate. Alternatively, the first hole passage 161 of the second heat exchange region is in communication with the connection port 102 through the third matching hole 137 of the fourth plate.

The connector in this embodiment includes a first connection port portion 43, a first connecting portion 44 and a second connecting portion 45. The first connection port portion 43 is provided with a first connection port 53, the first connecting portion 44 is provided with a second connection port 54, and the second connecting portion 45 is provided with a third connection port 55 and a fourth connection port 56.

In a specific vehicle air conditioning system, the first connection port portion 43 may be in communication with an outlet of a compressor, the second connection port 54 of the first connecting portion 44 may be in communication with an air return port of the compressor, the third connection port 55 of the second connecting portion 45 may be in communication with the evaporator or the throttling element or the like of the system, and the fourth connection port 56 may be in communication with an outlet of the evaporator or an outlet of a vapor-liquid separator or the like.

When the system is in operation, a high-temperature and high-pressure refrigerant may flow from the first connection port 53 into the second hole passage 162 of the second heat exchange region 16 (not illustrated in the figures), and exchanges heat in the second heat exchange region 16 with a refrigerant with a relatively low temperature in another fluid flow channel, and then flows to the first hole passage 161. In the first hole passage 161 of the second heat exchange region 16, the refrigerant is divided into two parts. One part of the refrigerant flows to the evaporator of the system through the third connection port 55 or through the throttling element, or flows to two evaporators after being throttled; the refrigerant, after being evaporated in the evaporator, flows to the fourth hole passage 164 of the second heat exchange region 16 through the fourth connection port 56, and performs heat exchange with the refrigerant with a relatively high temperature in the another fluid flow channel. The other part of the refrigerant flows to the throttling element 20 through the first hole 147 of the second plate, the third matching hole 137 of the fourth plate 13, the space between the first main plate face 120 of the third plate and the second main plate face 130' of the fourth plate or the first matching hole 127 of the third plate, and the connection port 102; and, after being throttled by the throttling element 20, the other part of the refrigerant flows to a part, relatively close to a side where the throttling element is located, of the first hole passage 151 of the first heat exchange region, exchanges heat with the medium in the another fluid flow channel, such as a coolant, in the first heat exchange region 15, flows to the second hole passage 152 of the first heat exchange region, and flows to the fourth hole passage 164 of the second heat exchange region through the second matching hole 128 of the third plate, the fourth matching hole 138 of the fourth plate, the space between the first main plate face 130 of the fourth plate and the main plate face 140 of the second plate, and the second hole 148 of the second plate, and is converged with the refrigerant coming back from the fourth hole passage and flows to the third hole passage 163, flows out through the second connection port 54 in communication with the third hole passage 163 to get to the compressor, of course, it may be returned back to the compressor through a vapor-liquid separator or the like.

Other structures and modes of this embodiment may be referred to the above third embodiment.

In the above embodiments, the number of the connection ports for the refrigerant connection is four. There may be five or six connection ports, for example, the system has two evaporators, where two of the connection ports lead to the two evaporators or to the throttling element and the evaporator respectively, and/or two of the connection ports are in communication with the outlets of the evaporators respectively. Alternatively, the connector may be of a one-piece structure rather than a combination of multiple parts as described in the embodiment.

The above heat exchanger may be used in a heat exchange assembly. The heat exchange assembly may be provided with a first coolant connection port portion 41 and a second coolant connection port portion 42, the first coolant connection port portion 41 is provided with a first coolant connection port 51 and the second coolant connection port portion 42 is provided with a second coolant connection port 52. The first coolant connection port 51 and the second coolant connection port 52 are in communication with each other through a coolant flow channel of the first heat exchange region, to perform heat exchange with the medium in another fluid flow channel, i.e., a refrigerant flow channel.

The first coolant connection port portion 41 and the second coolant connection port portion 42 are fixedly connected to the heat exchanger by welding, specifically the first coolant connection port portion 41 and the second coolant connection port portion 42 are arranged on a side relatively close to the first heat exchange region and are welded to side plates of the heat exchanger.

The refrigerant flow channel of the first heat exchange region of the above heat exchange assembly may be singlepass, i.e., from the first hole passage 151 to the second hole passage 152; or may be three-pass or even five-pass. Taking the three-pass case as an example, the first heat exchange region is substantially divided into three parts, where the first hole passage 151 is divided into a first part close to the throttling element and a second part relatively close to the third plate, and the second part of the first hole passage 151 is longer than the first part.

The second hole passage 152 is divided into a first part close to the throttling element and a second part relatively close to the third plate, and the second part of the second hole passage 152 is shorter than the first part. The first pass is from the first part of the first hole passage 151 to the first part of the second hole passage 152, then from a part, relatively close to the middle, of the first part of the second hole passage 152 to the second part of the first hole passage, and then from a part, relatively close to the third plate, of the second part of the second hole passage 151 to the second part of the second hole passage 103, only the flow from the second hole passage 152 is illustrated in the above embodiment.

The heat exchange assembly may be used in a vehicle thermal management system. The thermal management system includes a compressor, a heat exchange assembly, at least one evaporator, a second heat exchanger, a liquid reservoir or a gas-liquid separator, and at least one throttling element.

The thermal management system includes a refrigerant system and a coolant system, the medium flowing in the refrigerant system is the refrigerant and the medium flowing in the coolant system is the coolant. The first coolant connection port 51 and the second coolant connection port 52 are communicated through a coolant flow channel of the first heat exchange region. The first coolant connection port portion 101 and the second coolant connection port portion 102 may be part of a side plate of the first heat exchange region; or may be separately machined and secured to the side plate and/or the heat exchanger core of the first heat exchange region by welding; or the first coolant connection port portion and the second coolant connection port portion may be secured to the first heat exchange region by means of pipe connectors.

The refrigerant flow channel of the first heat exchange region includes a first hole passage and a second hole passage, and the coolant flow channel is not in communication with the refrigerant flow channel. The heat exchange assembly enables the thermal management system to be easily installed and connected, thereby reducing the number of pipes connected and reducing the size of the system.

The heat exchange assembly being used in a vehicle thermal management system is described as an example. It should be noted that, in practice, these components are fixed, and for clarity, the flow pattern of the refrigerant is shown in the exploded views, which is only for clarity to facilitate illustration.

The heat exchange assembly enables heat exchange between the high-temperature refrigerant and the low-temperature refrigerant, to reduce the high-temperature temperature, thereby increasing efficiency. The two parts of the low-temperature refrigerant is returned to the compressor together through the second connection port of the heat exchange assembly, which reduces the pipelines and makes the system connection simple and convenient. In another way, the heat exchange assembly enables the heat exchange between the high-temperature refrigerant and part of the low-temperature refrigerant, which reduces the temperature of the high-temperature refrigerant without making the temperature of refrigerant returning back to the compressor too high, thereby improving the efficiency, and the system connection is simple and convenient.

In this application, the flow direction is only for illustration, which is not a limit or an exclusive requirement, other components can be added, for example, adding other control valves before the compressor, for example, flowing to the evaporator may include the case that a throttling element is arranged before the evaporator, or even having a control valve or the like. These technical solutions may be adapted according to an actual system, and the communication is subject to the specific technical solutions.

In this application, the two components are communicated with each other or with other components are not an exclusive description, it means that the two are communicated, which includes the cases that there are other components, such as a throttling element, a separator, a control valve, a check valve, a heat exchanger or the like, between the two components.

In this application, the communication mode is not exclusive. For example, the second hole passage of the first heat exchange region being in communication with the first hole passage of the second heat exchange region through a matching hole in a plate, which means that a flow channel between the second hole passage of the first heat exchange region and the first hole passage of the second heat exchange region passes through the matching hole, the communication may be realized through the matching hole only, or may have many other manners such as the communication may be realized also through the matching hole of another plate or even the space between the two plates, other parts are similar.

In this application, for clarity of illustration, the serial numbers such as first, second, third, fourth are only used for clear distinguishing and the convenient description, which does not mean that the component necessarily needs to have four such structures, instead, it may have only one or two such structures. For example, the third plate includes the second matching portion and the fourth matching portion, which means that the third plate includes these two matching portions, rather than the third plate includes four matching portions. In the case that the second heat exchange region serves as an intermediate heat exchanger and the first heat exchange region serves as a cooler, the heat exchange assembly further needs a throttling element, so that the high-temperature refrigerant coming from the intermediate heat exchanger can be throttled by the throttling element, in the case that an electronic expansion valve is employed as the throttling element, the connection pipe may be extended to be connected to the high-temperature refrigerants; in the case that a throttling tube is employed, the throttling tube may be arranged in the first hole passage. These structures may be changed depending on the application of the system. In the above embodiments, the thickness of each of the four plates may be the same as the plate of the first heat exchange region, and the four plates may be similar in shape and size, only differing in the position of the matching portions, the holes, or the like; or, the shape and size may be different, for example, the third plate may extend outwards, thereby facilitating differentiating and identifying.

In addition, the matching portions facing and matching each other may protrude as described in the embodiments. Accessories such as a washer with a hole may be added between the matching portions. For example, the second matching portion of the third plate and the second matching portion of the fourth plate are flush with the body portion and are not projected, in order to make the two matching portions match and be welded to each other, a washer made of a suitable material is provided between the two matching portions, and the two matching portions are respectively welded with the washer to realize welding and fixing. The heat exchanger is provided with four plates, one of the fluid channels between two adjacent plates is communicated by the matching hole, and the other of the fluid channels is communicated through the space between the two plates. In this way, the two heat exchange regions with different functions can be welded together relatively easily to form a one-piece structure, and the one-piece heat exchanger with two heat exchange regions is realized by combining the two heat exchange regions through the matching portions of the plates and the matching holes, so that the second hole passage of the first heat exchange region is in communication with one of the hole passages of the second heat exchange region. In different situations of flow directions of refrigerant, the structures of the plates can be partially changed, for example, by changing the matching portions of the plates and the matching holes used for communication, various communication requirements for the system can be fulfilled, and the structure of the heat exchanger is relatively small.

It should be noted that the above embodiments are only used to illustrate the present application, and not to limit the technical solution described according to the present application, such as the definition of directionality such as "front", "rear", "left", "right", "up" and "down". In this specification, the present application has been described in detail with reference to the above embodiments, however, those skilled in the art should understand that they can still make modification, combination or equivalently replacement of the present application, and all technical solutions and improvements that do not depart from the spirit and scope of the present application shall fall within the scope claimed by the claims of the present application.

The invention claimed is:

1. A heat exchanger, wherein the heat exchanger comprises a first heat exchange region and a second heat exchange region; the first heat exchange region comprises a first plate, and the second heat exchange region comprises a second plate;

the heat exchanger further comprises a third plate and a fourth plate;

a body portion of the third plate is located between the first plate and the fourth plate, and a body portion of the fourth plate is located between the third plate and the second plate;

the second heat exchange region comprises two fluid flow channels, wherein heat is allowed to be exchanged between the two fluid flow channels;

the first heat exchange region comprises a first hole passage and a second hole passage, the second heat exchange region comprises four passages, namely a first hole passage, a second hole passage, a third hole passage and a fourth hole passage, two holes for communication, namely a first hole and a second hole, are provided at a side, closest to the first heat exchange region, of the second heat exchange region, and the first hole and the second hole are provided in the second plate;

the third plate comprises at least two matching portions, each of the at least two matching portions of the third plate is provided with a matching hole, and the at least two matching holes of the third plate comprises a first matching hole and a second matching hole;

the fourth plate comprises at least two matching portions, each of the at least two matching portions of the fourth plate is provided with a matching hole, and the at least two matching holes of the fourth plate comprises a third matching hole and a fourth matching hole;

one of the at least two matching portions of the third plate where the second matching hole is located to face and secured by welding to one of the at least two matching portions of the fourth plate where the fourth matching hole is located, and the second matching hole of the third plate faces and is in communication with the fourth matching hole of the fourth plate;

the second plate comprises at least one matching portion, one of the first hole and the second hole is provided in one of the at least one matching portion of the second plate, another one of the at least two matching portions of the fourth plate where the third matching hole is located to face and secured by welding to the one of the at least one matching portion of the second plate, and the third matching hole of the fourth plate is in communication with the one of the first hole and the second hole provided in the one of the at least one matching portion of the second plate; and the second hole passage of the first heat exchange region is in communication with one of the hole passages of the second heat exchange region through the third plate and the fourth plate;

the third plate comprises a first main plate face and a second main plate face opposite to each other, and the fourth plate also comprises a first main plate face and a second main plate face opposite to each other;

the one of the at least two matching portions of the third plate where the second matching hole is located protrudes towards the fourth plate with respect to the first main plate face of the third plate, and the first matching hole of the third plate is in communication with a space between the third plate and the fourth plate;

one of the at least two matching portions of the fourth plate where the fourth matching hole is located protrudes towards the third plate with respect to the second main plate face of the fourth plate, and another one of the at least two matching portions of the fourth plate where the third matching hole is located protrudes towards the second plate with respect to the first main plate face of the fourth plate; and the fourth matching hole of the fourth plate is in communication with a space between the fourth plate and the second plate, and the third matching hole of the fourth plate is in communication with a space between the third plate and the fourth plate.

2. The heat exchanger according to claim 1, wherein the heat exchanger further comprises a connection pipe;

at least part of the connection pipe is located in the first hole passage of the first heat exchange region, the first plate comprises a matching portion protruding towards the second plate, another one of the at least two matching portions of the third plate where the first matching hole is located protrudes towards the first plate, the another one of the at least two matching portions of the third plate protruding towards the first plate matches and is welded to the matching portion of the first plate protruding towards the third plate or the connection pipe;

the first heat exchange region comprises two fluid flow channels, one of the fluid flow channels comprises the first hole passage and the second hole passage, the other of the fluid flow channels of the first heat exchange region comprises a third hole passage and a fourth hole passage, the second hole passage of the first heat exchange region is in communication with one of the fluid flow channels of the second heat exchange region through the third plate and the fourth plate, and a communication port of the connection pipe is in communication with the other of the fluid flow channels of the second heat exchange region.

3. The heat exchanger according to claim 1, wherein the first plate, the third plate, the fourth plate and the second plate are each provided with a flange portion at a peripheral side thereof; and the flange portions of the first plate, the third plate, the fourth plate, and the second plate face towards a same side, the flange portion of the first plate is secured by welding to the flange portion of the third plate, the flange portion of the third plate is secured by welding to the flange portion of the fourth plate, and the flange portion of the fourth plate is secured by welding to the flange portion of the second plate.

4. The heat exchanger according to claim 3, wherein the first heat exchange region has a heat exchange core, and the first heat exchange region comprises a plurality of plates and further comprises fins in the heat exchange core;

the first plate, the third plate, the fourth plate and the second plate are arranged in sequence, and a body portion of at least one of the first plate, the third plate, the fourth plate and the second plate is provided with a concave-convex structure.

5. A heat exchange assembly, wherein the heat exchange assembly comprises a throttling element, a connector and the heat exchanger according to claim 1;

the throttling element is arranged to the first heat exchange region and is arranged with the heat exchanger in a secured or limited manner;

the heat exchange assembly comprises a first connection port, a second connection port, a third connection port and a fourth connection port;

the connector is fixed to the heat exchanger; the second hole passage of the first heat exchange region is in communication with one of the fluid flow channels of the second heat exchange region an inlet of the throttling element is in communication with the other of the fluid flow channels of the second heat exchange region, and an outlet of the throttling element is in communication with the first hole passage of the first heat exchange region.

6. The heat exchange assembly according to claim 5, wherein the heat exchange assembly comprises a connection pipe, the connection pipe is in communication with the inlet of the throttling element, and the connection pipe is secured by welding to the first plate and/or the second plate;

the first connection port, the second connection port, the third connection port, and the fourth connection port are provided at the connector, and the first connection port, the second connection port, the third connection port, and the fourth connection port are in communication with the hole passages of the second heat exchange region, respectively;

the heat exchange assembly further comprises a first coolant connection port portion and a second coolant connection port portion, the first heat exchange region comprises two fluid flow channels, namely a refrigerant flow channel and a coolant flow channel, wherein the refrigerant flow channel comprises the first hole passage and the second hole passage, and the coolant flow channel of the first heat exchange region comprises a third hole passage and a fourth hole passage.

7. A thermal management system, wherein the thermal management system comprises a refrigerant flow channel and further comprises the heat exchange assembly according to claim 5;

the thermal management system further comprises a compressor, a condenser and at least one evaporator; wherein an outlet of the condenser is in communication with the first connection port through a pipeline, or a liquid reservoir is arranged between an outlet of the condenser and the first connection port;

an inlet of the compressor is in communication with the second connection port; an inlet of the evaporator is in communication with the third connection port or the thermal management system further comprises another throttling element between an inlet of the evaporator and the third connection port; and an outlet of the evaporator is in communication with the fourth connection port.

8. The thermal management system according to claim 7, wherein the thermal management system further comprises a coolant flow channel;

the first heat exchange region further comprises a first coolant connection port portion and a second coolant connection port portion;

the first coolant connection port portion is provided with a first coolant connection port, and the second coolant connection port portion is provided with a second coolant connection port; and the coolant flow channel passes through the first coolant connection port portion, the second coolant connection port portion and the coolant flow channel, in communication with the first coolant connection port and the second coolant connection port, of the first heat exchange region.

9. The heat exchanger according to claim 2, wherein the first plate, the third plate, the fourth plate and the second plate are each provided with a flange portion at a peripheral side thereof; and the flange portions of the first plate, the third plate, the fourth plate, and the second plate face towards a same side, the flange portion of the first plate is secured by welding to the flange portion of the third plate, the flange portion of the third plate is secured by welding to the flange portion of the fourth plate, and the flange portion of the fourth plate is secured by welding to the flange portion of the second plate.

10. A thermal management system, wherein the thermal management system comprises a refrigerant flow channel and further comprises the heat exchange assembly according to claim 6;

the thermal management system further comprises a compressor, a condenser and at least one evaporator; wherein an outlet of the condenser is in communication with the first connection port through a pipeline, or a liquid reservoir is arranged between an outlet of the condenser and the first connection port;

an inlet of the compressor is in communication with the second connection port; an inlet of the evaporator is in communication with the third connection port or the thermal management system further comprises another throttling element between an inlet of the evaporator and the third connection port; and an outlet of the evaporator is in communication with the fourth connection port.

* * * * *